US007339558B2

(12) United States Patent
Chen et al.

(10) Patent No.: US 7,339,558 B2
(45) Date of Patent: Mar. 4, 2008

(54) DRIVER CIRCUIT FOR PLASMA DISPLAY PANELS

(75) Inventors: Bi-Hsien Chen, Ping-Tung Hsien (TW); Yi-Min Huang, Taipei (TW); Shin-Chang Lin, Taipei Hsien (TW); Liang-Che Cho, Hsin-Chu Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 517 days.

(21) Appl. No.: 10/908,611

(22) Filed: May 19, 2005

(65) Prior Publication Data

US 2006/0238449 A1 Oct. 26, 2006

Related U.S. Application Data

(63) Continuation-in-part of application No. 10/907,892, filed on Apr. 20, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66, 211; 313/567; 315/169.3, 315/169.4

See application file for complete search history.

(56) References Cited

U.S. PATENT DOCUMENTS 5,670,974 A 9/1997 Ohba et al.
5,828,353 A 10/1998 Kishi et al.
6,628,275 B2 * 9/2003 Vossen et al. ..... 345/211
6,680,581 B2 * 1/2004 Lee et al. ..... 315/169.3
6,768,270 B2 * 7/2004 Chae ..... 315/169.3
6,781,322 B2 * 8/2004 Onozawa et al. ..... 315/169.3
6,933,679 B2 * 8/2005 Lee et al. ..... 315/169.4
6,961,031 B2 * 11/2005 Lee et al. ..... 345/60
7,023,139 B2 * 4/2006 Lee et al. ..... 315/169.1
7,027,010 B2 * 4/2006 Lee ..... 345/60
7,123,219 B2 * 10/2006 Lee ..... 345/76
7,176,854 B2 * 2/2007 Lee et al. ..... 345/60
2003/0071578 A1 * 4/2003 Lee et al. ..... 315/169.3
2003/0173905 A1 * 9/2003 Lee et al. ..... 315/169.3
2003/0193454 A1 * 10/2003 Lee et al. ..... 345/63
2004/0012546 A1 * 1/2004 Takagi et al. ..... 345/60
2004/0135746 A1 * 7/2004 Lee et al. ..... 345/60
2006/0238447 A1 * 10/2006 Chen ..... 345/60
2006/0267874 A1 * 11/2006 Chen et al. ..... 345/68

* cited by examiner

*Primary Examiner*—Ricardo Osorio
(74) *Attorney, Agent, or Firm*—Winston Hsu

(57) ABSTRACT

A driver circuit for plasma display panels is provided. The claimed driver circuit includes three switches and an energy recovery circuit coupled to an equivalent capacitor of a plasma display panel. The present energy recovery circuit includes a first unit coupled to the X side of an equivalent capacitor and to a first switch, for passing current of charging and/or discharging the equivalent capacitor from the X side; a second unit coupled to the Y side of the equivalent capacitor and to the first switch, for passing current of charging and/or discharging the equivalent capacitor from the Y side; and a third unit coupled to the first switch and ground. The third unit includes a capacitor for charging and/or discharging the equivalent capacitor from the X side and/or the Y side, and a fourth switch coupled to the capacitor in series.

18 Claims, 10 Drawing Sheets

DRIVER CIRCUIT FOR PLASMA DISPLAY PANELS

CROSS REFERENCE TO RELATED APPLICATIONS

This is a continuation-in-part of application Ser. No. 10/907,892, filed Apr. 20, 2005, and which is included in its entirety herein by reference.

BACKGROUND OF INVENTION

1. Field of the Invention

The present invention relates to a driver circuit, and more particularly, to a driver circuit for plasma display panels.

2. Description of the Prior Art

In recent years, there has been an increasing demand for planar matrix displays such as plasma display panels (PDP), liquid-crystal displays (LCD) and electroluminescent displays (EL display) in place of cathode ray tube terminals (CRT) due to the advantage of the thin appearance of the planar matrix displays. This kind of planar display is, in general, designed to achieve display through discharge glow in which charges accumulated over electrodes are released with application of a given voltage.

In a PDP display, charges are accumulated according to display data, and a sustaining discharge pulse is applied to paired electrodes in order to initiate discharge glow for display. As far as the PDP display is concerned, it is required to apply a high voltage to the electrodes. In particular, a pulse-duration of several microseconds is adopted usually. Hence the power consumption of the PDP display is quite considerable. Energy recovering (power saving) is therefore sought for. Many designs and patents have been developed for providing methods and apparatus of energy recovering for PDP. One of the examples is US Pat. No. 5,828,353, "Drive Unit for Planar Display" by Kishi, et al., which is included herein by reference.

Please refer to FIG. 1. FIG. 1 is a block diagram of a prior art driver circuit 1 00. An equivalent capacitor of a plasma display panel is marked as Cpanel. The conventional driver circuit 100 includes four switches S1 to S4 for passing current, an X-side energy recovery circuit 110 and a Y-side energy recovery circuit 120 for charging/discharging the capacitor Cpanel from the X side of the capacitor Cpanel and the Y side of the capacitor Cpanel respectively. S5, S6, S7 and S8 are switches for passing current. D5, D6, D7 and D8 are diodes. V1 and V2 are two voltage sources. C1 and C2 are capacitors adopted for recovering energy, and L1 and L2 are resonant inductors. The X-side energy recovery circuit 110 includes an energy-forward channel comprising the switch S6, the diode D6 and the inductor L1, and an energy-backward channel comprising the inductor L1, the diode D5 and the switch S5. Similarly, the Y-side energy recovery circuit 120 also includes an energy-forward channel comprising the switch S8, the diode D8 and the inductor L2, and an energy-backward channel comprising the inductor L2, the diode D7 and the switch S7.

Please refer to FIG. 2. FIG. 2 is a flowchart of generating the sustaining pulses of the equivalent capacitor Cpanel of the PDP by the conventional driver circuit 100 illustrated in FIG. 1.

Step 200: Start;

Step 210: Keep the voltage potentials at the X side and the Y side of the capacitor Cpanel at ground by turning on the switches S3 and S4 and turning off other switches;

Step 220: Charge the X side of the capacitor Cpanel by the capacitor C1 and keep the voltage potential at the Y side of the capacitor Cpanel at ground by turning on the switches S6 and S4 and turning off other switches; wherein the voltage potential at the X side of the capacitor Cpanel goes up to V1 accordingly;

Step 230: Ignite the equivalent capacitor Cpanel of the PDP from the X side by turning on the switches S1 and S4 and turning off other switches; wherein the voltage potential at the X side of the capacitor Cpanel keeps at V1 and the voltage potential at the Y side of the capacitor Cpanel keeps at ground accordingly;

Step 240: Discharge the capacitor Cpanel from the X side and keep the voltage potential at the Y side of the capacitor Cpanel at ground by turning on the switches S5 and S4 and turning off other switches; wherein the voltage potential at the X side of the capacitor Cpanel goes down to ground accordingly;

Step 250: Keep the voltage potentials at the X side and the Y side of the capacitor Cpanel at ground by turning on the switches S3 and S4 and turning off other switches;

Step 260: Charge the Y side of the capacitor Cpanel by the capacitor C2 and keep the voltage potential at the X side of the capacitor Cpanel at ground by turning on the switches S8 and S3 and turning off other switches; wherein the voltage potential at the Y side of the capacitor Cpanel goes up to V2 accordingly;

Step 270: Ignite the equivalent capacitor Cpanel of the PDP from the Y side by turning on the switches S2 and S3 and turning off other switches; wherein the voltage potential at the Y side of the capacitor Cpanel keeps at V2 and the voltage potential at the X side of the capacitor Cpanel keeps at ground accordingly;

Step 280: Discharge the capacitor Cpanel from the Y side and keep the voltage potential at the X side of the capacitor Cpanel at ground by turning on the switches S7 and S3 and turning off other switches; wherein the voltage potential at the Y side of the capacitor Cpanel goes down to ground accordingly;

Step 290: Keep the voltage potentials at the X side and the Y side of the capacitor Cpanel at ground by turning on the switches S3 and S4 and turning off other switches;

Step 295: End.

Please refer to FIG. 3. FIG. 3 shows a diagram illustrating the voltage potentials at the X side and the Y side of the capacitor Cpanel, and the control signals, M1 to M8, of the switches S1 to S8 in FIG. 1 respectively. In FIG. 3, the horizontal axis represents the time, while the vertical axis represents the voltage potential. Note that the switches S1 to S8 are designed to close (turned on) for passing current when the control signal is high, and to open (turned off) such that no current can pass when the control signal is low.

Conventionally, the energy recovery (power saving) circuit provides two individual channels of charging and discharging the equivalent capacitor respectively (energy-forward channel and energy-backward channel) for each side of the equivalent capacitor Cpanel. Further, it is required to utilize a switch at each side of the equivalent capacitor Cpanel in order to control the connection between the side of the equivalent capacitor Cpanel and a voltage source, even though the voltage sources supplied to the two sides of the equivalent capacitor of the plasma display panel are usually identical. Therefore, the amount of required components is quite large. Hence the cost of energy recovery circuit is not easy to reduce.

SUMMARY OF INVENTION

It is therefore a primary objective of the claimed invention to provide a driver circuit for plasma display panels.

Briefly described, the claimed invention discloses a driver circuit for plasma display panels. The driver circuit for plasma display panels includes a first switch having a first end coupled to a first voltage source, a second switch having a first end coupled to an X side of an equivalent capacitor and a second end coupled to ground, a third switch having a first end coupled to a Y side of the equivalent capacitor and a second end coupled to ground. The energy recovery circuit includes three units. The first unit of the energy recovery circuit has a first end coupled to the X side of an equivalent capacitor and a second end coupled to a second end of the first switch, for passing current of charging and/or discharging the equivalent capacitor from the X side. The second unit of the energy recovery circuit has a first end coupled to the Y side of the equivalent capacitor and a second end coupled to the second end of the first switch, for passing current of charging and/or discharging the equivalent capacitor from the Y side. And the third unit of the energy recovery circuit is coupled to the second end of the first switch and ground, including a capacitor for charging and/or discharging the equivalent capacitor from the X side and/or the Y side, and a fourth switch coupled to the capacitor in series.

The claimed invention further discloses another driver circuit for plasma display panels. The driver circuit for plasma display panels includes a first switch having a first end coupled to a first voltage source, a second switch having a first end coupled to an X side of an equivalent capacitor and a second end coupled to a second voltage source, a third switch having a first end coupled to a Y side of the equivalent capacitor and a second end coupled to a third voltage source. The energy recovery circuit includes a first unit, having a first end coupled to the X side of an equivalent capacitor and a second end coupled to a second end of the first switch, for passing current of charging and/or discharging the equivalent capacitor from the X side; a second unit, having a first end coupled to the Y side of the equivalent capacitor and a second end coupled to the second end of the first switch, for passing current of charging and/or discharging the equivalent capacitor from the Y side; and a third unit, for passing charging and/or discharging current of the equivalent capacitor from the X side and/or the Y side, coupled to the second end of the first switch and ground, the third unit comprising a fourth switch.

It is an advantage of the present invention that in the energy recovery circuit, only one positive voltage source is required to serve for the both sides of the equivalent capacitor of the plasma display panel. The drawback of the great amount of required components in prior art is moderated, and the area of chips is hence reduced.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
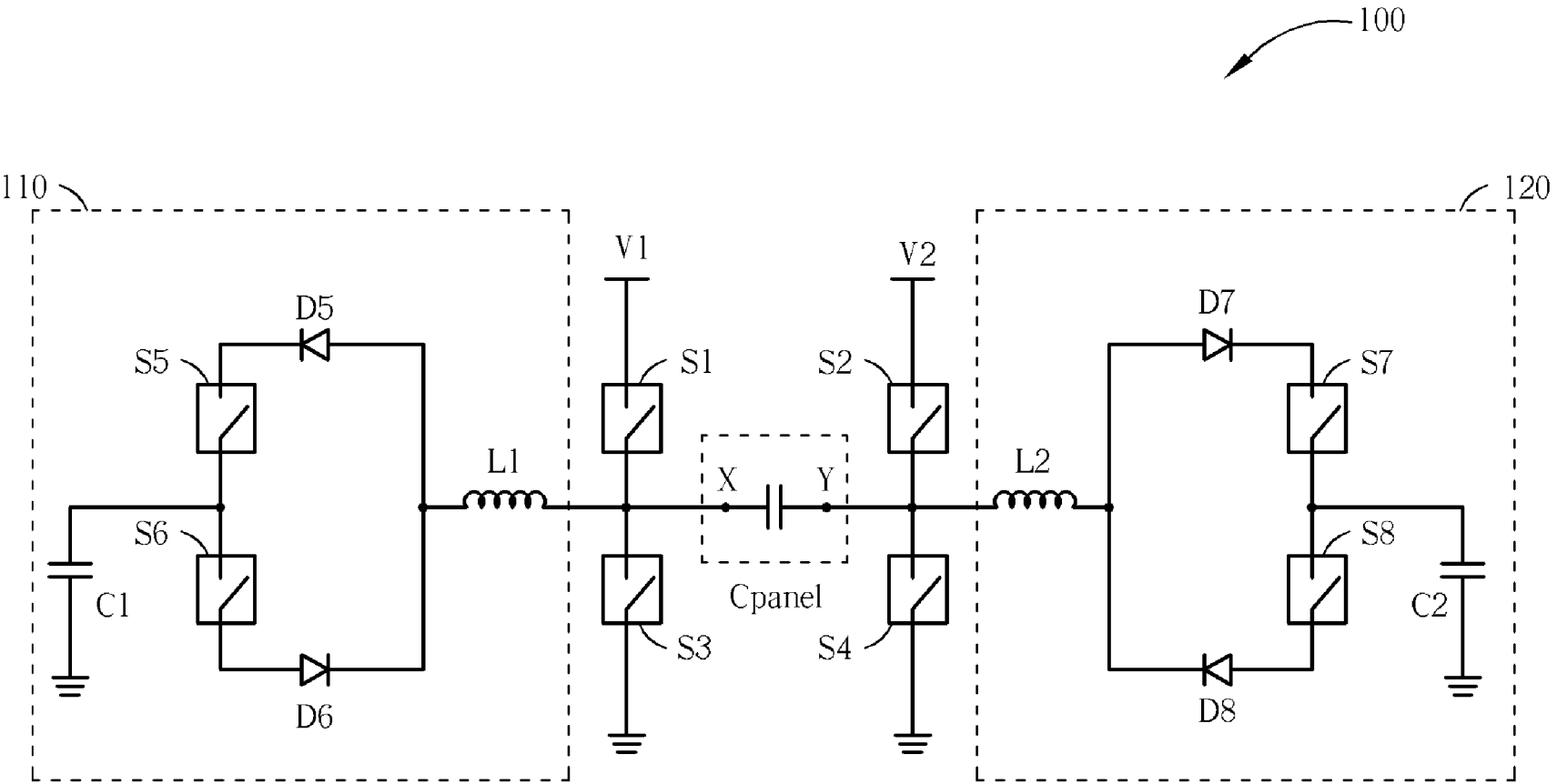
Fig. 1 Prior art
FIG. 1 is a block diagram of a prior art energy recovery circuit with an equivalent capacitor of a PDP.
Figure 2:
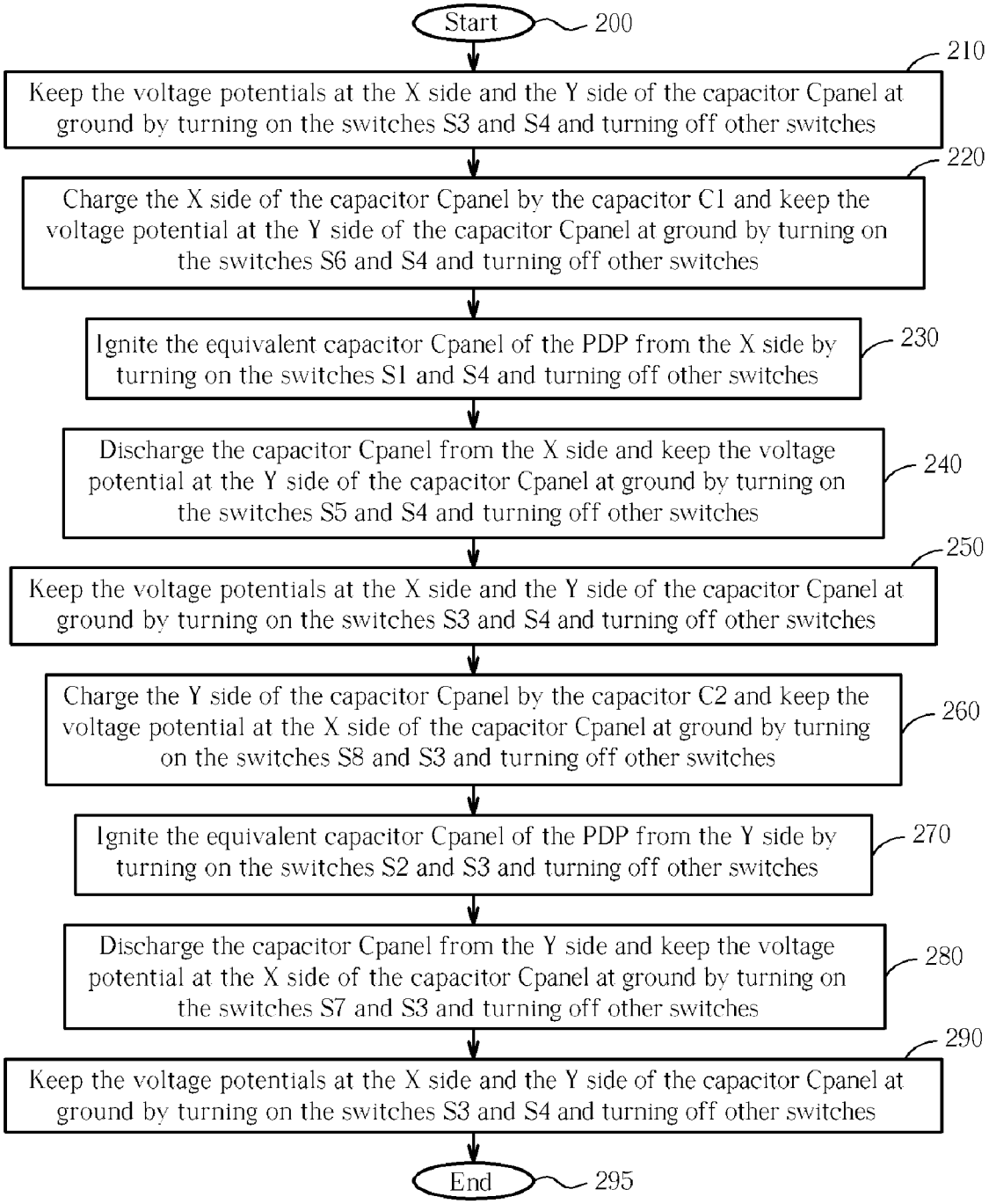
Fig. 2 Prior art
FIG. 2 is a flowchart of a prior art method of generating the sustaining pulses of the equivalent capacitor Cpanel.
Figure 3:
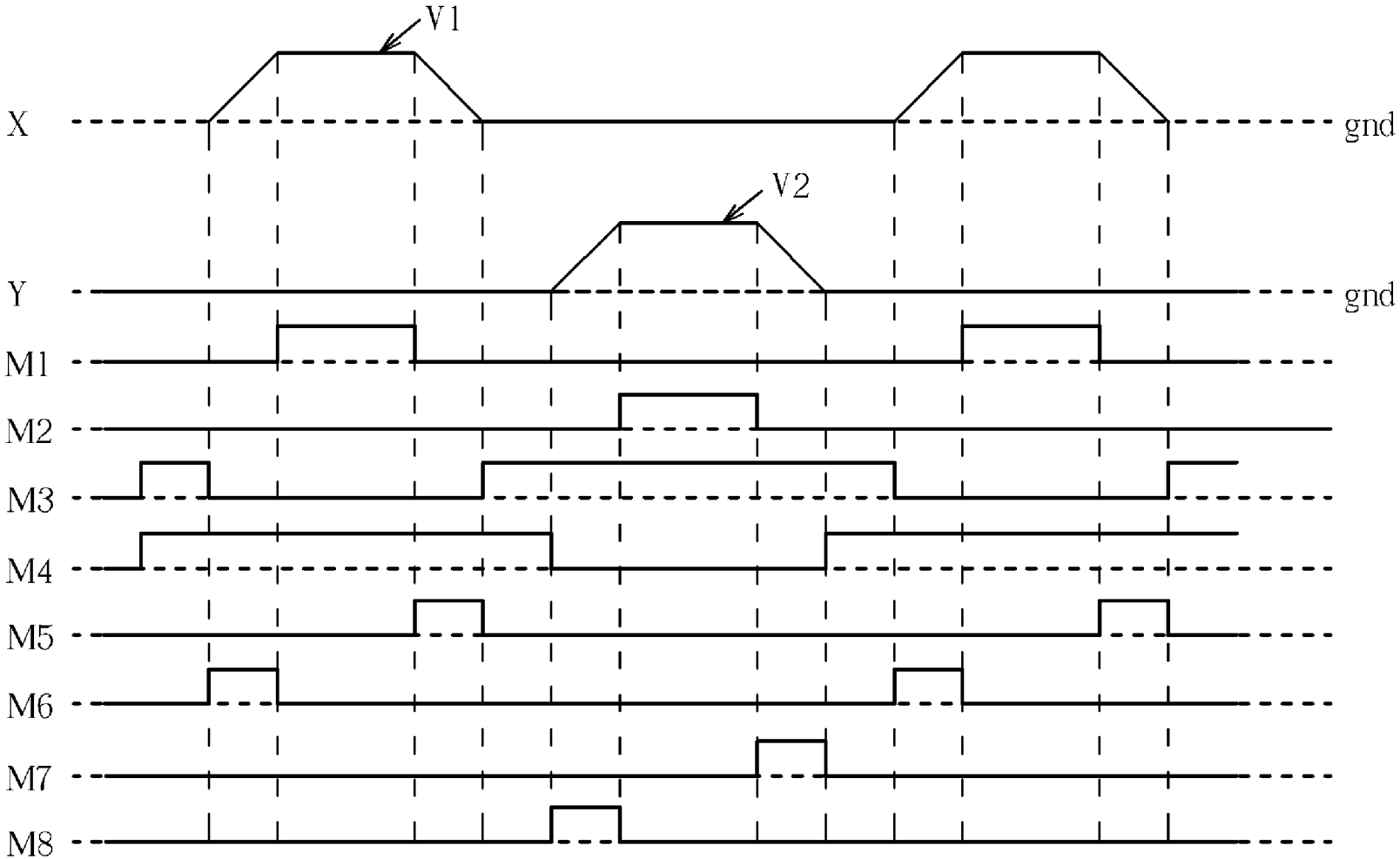
Fig. 3 Prior art
FIG. 3 is a diagram illustrating the voltage potentials at sides of the capacitor Cpanel and the control signals of the switches.
Figure 4:
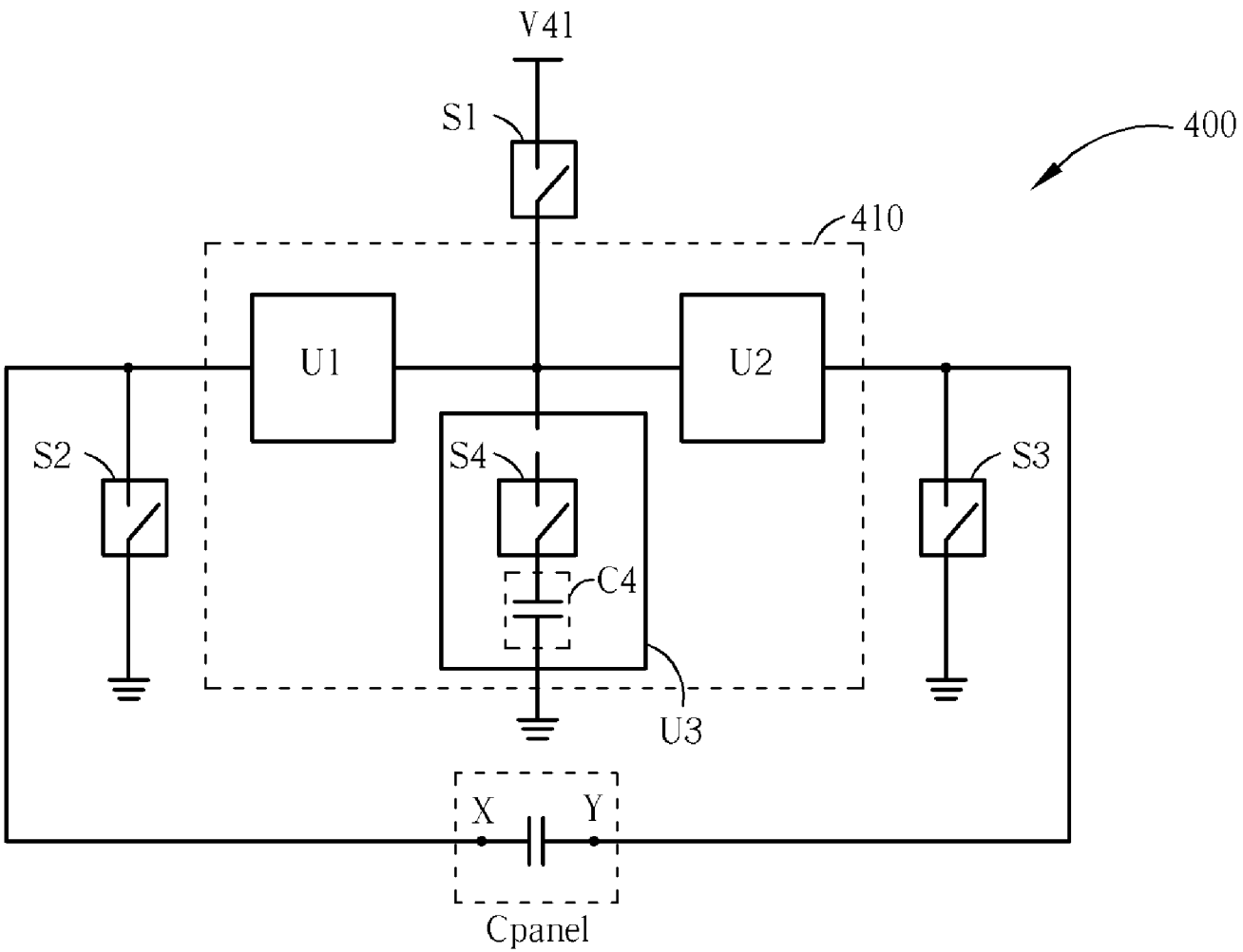
FIG. 4 is a block diagram of a first type of the present invention driver circuit with an equivalent capacitor of a PDP.

As aforementioned, the voltage source provided to igniting the X side of the equivalent capacitor of a PDP is usually the same as the voltage source provided to igniting the Y side of the equivalent capacitor of a PDP. In this practical and usual case, the two voltage sources can be combined into one. Please refer to FIG. 4. FIG. 4 is a block diagram of the present invention driver circuit 400 and an equivalent capacitor of a PDP (plasma display panel), Cpanel. Unlike the prior art, the charging/discharging unit of the X side of the equivalent capacitor Cpanel and the charging/discharging unit of the Y side of the equivalent capacitor Cpanel are combined as the energy recovery circuit 410 shown in FIG. 4. A first switch S1 is coupled to a first voltage source V41, which serves to both sides of an equivalent capacitor Cpanel. A second switch S2 is coupled to an X side of the equivalent capacitor and ground. And a third switch S3 is coupled to a Y side of the equivalent capacitor and ground. The present energy recovery circuit 410 includes a first unit U1 coupled to the X side of an equivalent capacitor Cpanel and to the first switch S1, utilized to passing current of charging and/or discharging the equivalent capacitor Cpanel from the X side; and a second unit U2 coupled to the Y side of the equivalent capacitor and to the first switch S1, for passing current of charging and/or discharging the equivalent capacitor Cpanel from the Y side. The present energy recovery circuit 410 further includes a third unit U3 coupled to the first switch S1 and ground. The third unit is equipped with a capacitor C4 for charging and/or discharging the equivalent capacitor from the X side and/or the Y side, and a fourth switch S4 coupled to the capacitor in series.

Figure 5:
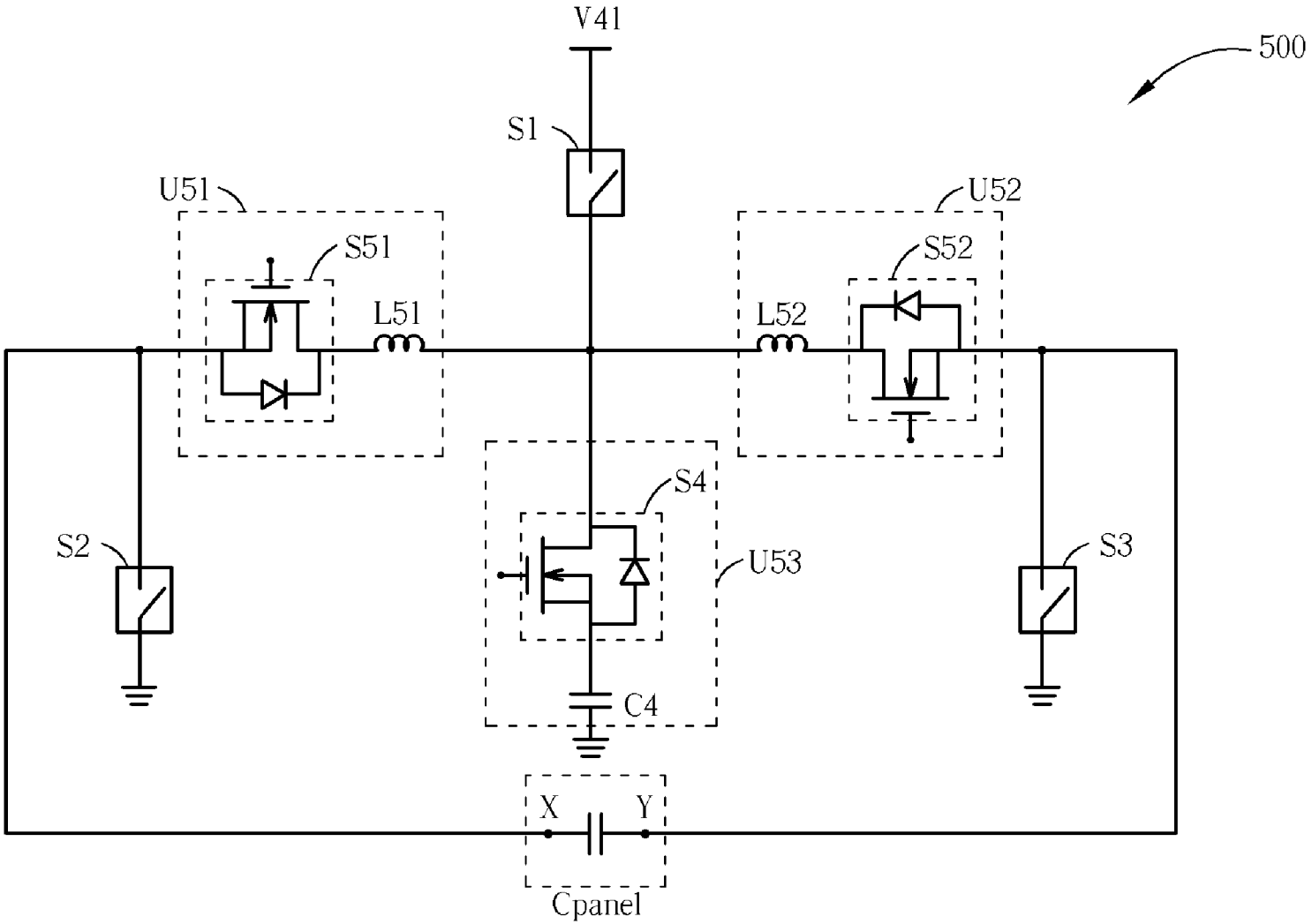
FIG. 5 is a block diagram of the first embodiment of the present invention driver circuit with an equivalent capacitor of a PDP.

Please refer to FIG. 5. FIG. 5 is a block diagram of the first embodiment 500 of the present invention driver circuit. In this embodiment, each of the unit U51 and the unit U52 includes a switch and an inductor. The switch S4 of the unit U53 is directly coupled to the two inductors of the unit U51 and the unit U52. The charging/discharging unit of the X side of the equivalent capacitor Cpanel is composed of the switches S4 and S51, an inductor L51, and the capacitor C4; while the charging/discharging unit of the Y side of the equivalent capacitor Cpanel is composed of the switches S4 and S52, the inductor L52, and the capacitor C4. The voltage source V41 is coupled to both the charging/discharging unit of the X side of the equivalent capacitor Cpanel and the charging/discharging unit of the Y side of the equivalent capacitor Cpanel for igniting the X side and the Y side of the equivalent capacitor Cpanel respectively.

Figure 6:
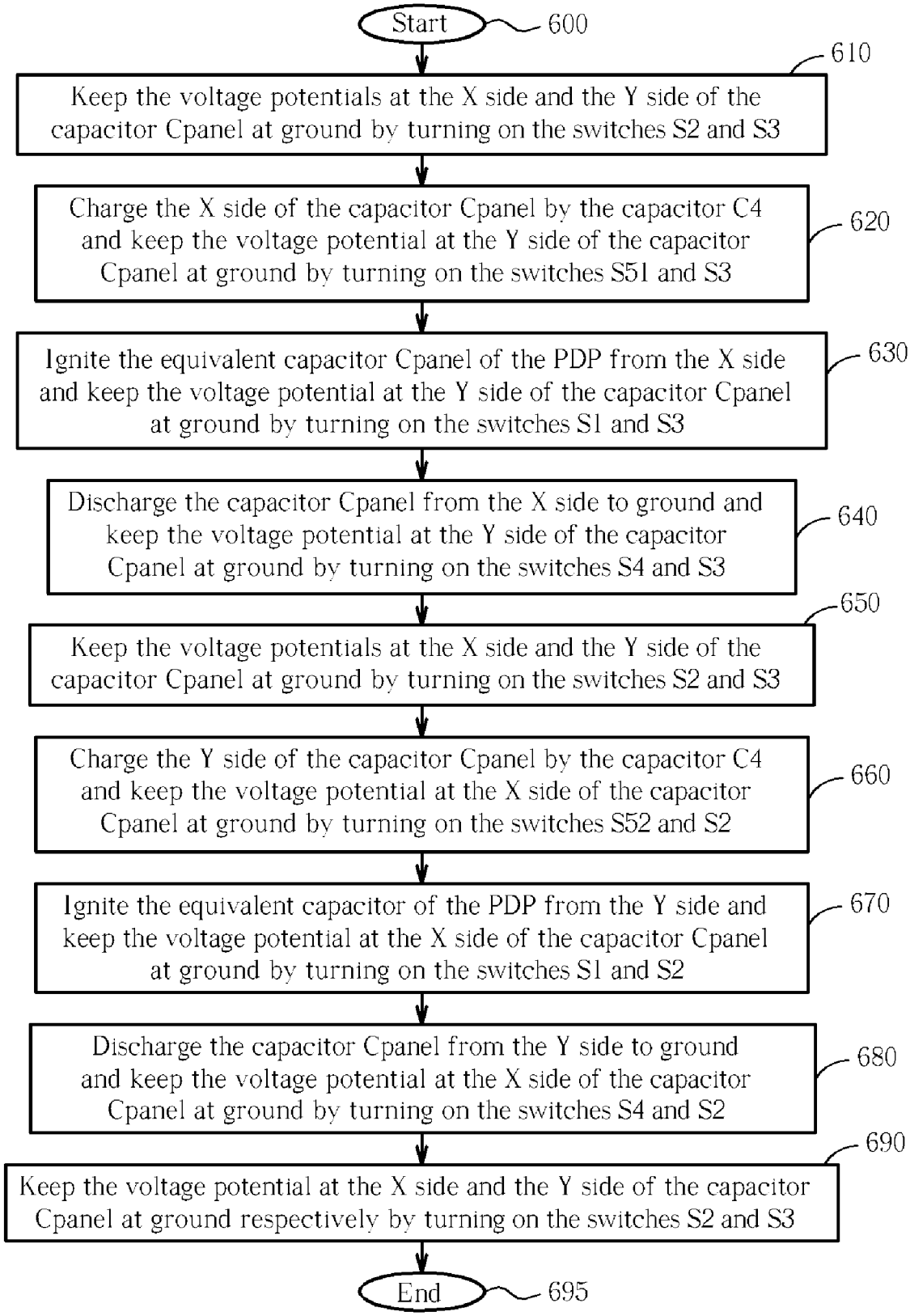
FIG. 6 is a flowchart of the present invention method of generating the sustaining pulses of the equivalent capacitor Cpanel.

The two sides of the equivalent capacitor Cpanel are coupled to the same voltage source V41 such that the energy recovery circuit of the present invention driver circuit is simplified obviously, and the number of adopt components are reduced. Please refer to FIG. 6 to see the flow of generating the sustaining pulses of the equivalent capacitor Cpanel of the PDP by the first embodiment 500 of the present invention driver circuit illustrated in FIG. 5.

Step 600: Start;

Step 610: Keep the voltage potentials at the X side and the Y side of the capacitor Cpanel at ground by turning on the switches S2 and S3;

Step 620: Charge the X side of the capacitor Cpanel by the capacitor C4 and keep the voltage potential at the Y side of the capacitor Cpanel at ground by turning on the switches S51 and S3; wherein the voltage potential at the X side of the capacitor Cpanel goes up to V41 and the voltage potential at the Y side of the capacitor Cpanel keeps at ground accordingly;

Step 630: Ignite the equivalent capacitor Cpanel of the PDP from the X side and keep the voltage potential at the Y side of the capacitor Cpanel at ground by turning on the switches S1 and S3; wherein the voltage potential at the X side of the capacitor Cpanel keeps at V41 and the voltage potential at the Y side of the capacitor Cpanel keeps at ground accordingly;

Step 640: Discharge the capacitor Cpanel from the X side to ground and keep the voltage potential at the Y side of the capacitor Cpanel at ground by turning on the switches S4 and S3; wherein the voltage potential at the X side of the capacitor Cpanel goes down to ground and the voltage potential at the Y side of the capacitor Cpanel keeps at ground accordingly;

Step 650: Keep the voltage potentials at the X side and the Y side of the capacitor Cpanel at ground by turning on the switches S2 and S3;

Step 660: Charge the Y side of the capacitor Cpanel by the capacitor C4 and keep the voltage potential at the X side of the capacitor Cpanel at ground by turning on the switches S52 and S2; wherein the voltage potential at the Y side of the capacitor Cpanel goes up to V41 and the voltage potential at the X side of the capacitor Cpanel keeps at ground accordingly;

Step 670: Ignite the equivalent capacitor of the PDP from the Y side and keep the voltage potential at the X side of the capacitor Cpanel at ground by turning on the switches S1 and S2; wherein the voltage potential at the Y side of the capacitor Cpanel keeps at V41 and the voltage potential at the X side of the capacitor Cpanel keeps at ground accordingly;

Step 680: Discharge the capacitor Cpanel from the Y side to ground and keep the voltage potential at the X side of the capacitor Cpanel at ground by turning on the switches S4 and S2; wherein the voltage potential at the Y side of the capacitor Cpanel goes down to ground and the voltage potential at the X side of the capacitor Cpanel keeps at ground accordingly;

Step 690: Keep the voltage potential at the X side and the Y side of the capacitor Cpanel at ground respectively by turning on the switches S2 and S3;

Step 695: End.

Figure 7:
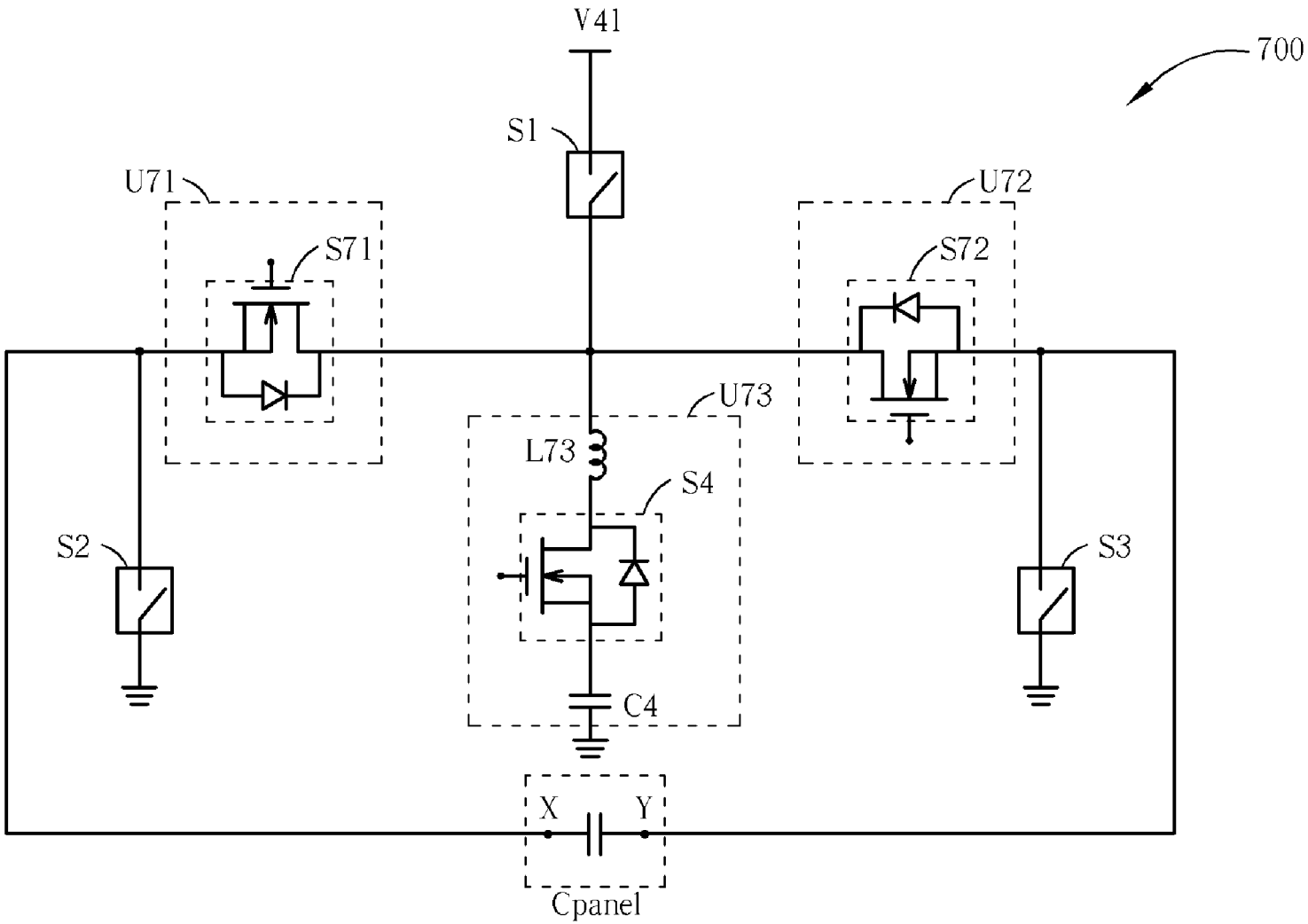
FIG. 7 is a block diagram of the second embodiment of the present invention driver circuit with an equivalent capacitor of a PDP.

Please refer to FIG. 7. FIG. 7 is a block diagram of the second embodiment 700 of the present invention driver circuit. In this embodiment, each of the unit U71 and the unit U72 includes only a switch. The unit U73 includes a switch S4, a capacitor C4, and an inductor L73, coupled in series. The inductor L73 of the unit U73 is utilized in both the charging/discharging unit of the X side of the equivalent capacitor Cpanel and the charging/discharging unit of the Y side of the equivalent capacitor Cpanel. The voltage source V41 is coupled to both the charging/discharging unit of the X side of the equivalent capacitor Cpanel and the charging/discharging unit of the Y side of the equivalent capacitor Cpanel for igniting the X side and the Y side of the equivalent capacitor Cpanel respectively. When charging the X side of the capacitor Cpanel, the switch S71 is turned on, and the X side of the capacitor Cpanel is charged by the capacitor C4; while the switch S3 is turned on to keep the voltage potential at the Y side of the capacitor Cpanel at ground. When igniting the X side of the capacitor Cpanel, the switch S1 is turned on for passing current from the voltage source V41 to the X side of the capacitor Cpanel; while the switch S3 remains turned on to keep the voltage potential at the Y side of the capacitor Cpanel at ground. When discharging the X side of the capacitor Cpanel, the switch S4 is turned on for passing current from the X side of the capacitor Cpanel through the inductor L51 back to the capacitor C4.

Similarly, when charging the Y side of the capacitor Cpanel in the present invention driver circuit 700, the switch S72 is turned on, and the Y side of the capacitor Cpanel is charged by the capacitor C4; while the switch S2 is turned on to keep the voltage potential at the X side of the capacitor Cpanel at ground. When igniting the Y side of the capacitor Cpanel, the switch S1 is turned on for passing current from the voltage source V41 to the Y side of the capacitor Cpanel; while the switch S2 remains turned on to keep the voltage potential at the X side of the capacitor Cpanel at ground. When discharging the Y side of the capacitor Cpanel, the switch S4 is turned on for passing current from the Y side of the capacitor Cpanel through the inductor L72 back to the capacitor C4.

Figure 8:
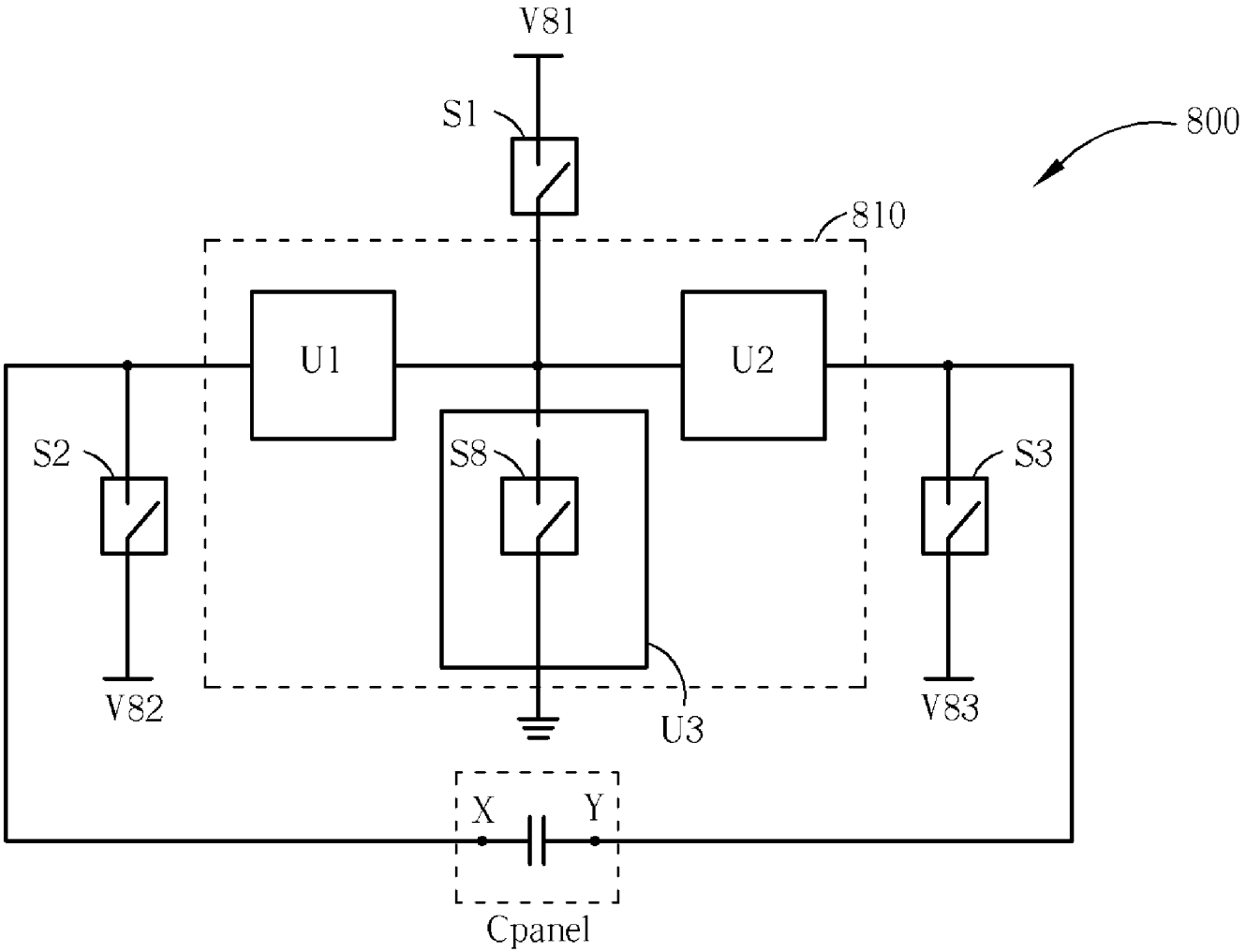
FIG. 8 is a block diagram of a second type of the present invention driver circuit with an equivalent capacitor of a PDP.

In the prior art and even in the aforementioned embodiments of the present invention driver circuit of PDP, it is necessary to adopt at least one capacitor to implement the energy recovery job. Please refer to FIG. 8. FIG. 8 is a block diagram of another type of driver circuit 800 of the present invention with an equivalent capacitor of a PDP, Cpanel. Each of the charging/discharging unit of the X side of the equivalent capacitor Cpanel and the charging/discharging unit of the Y side of the equivalent capacitor Cpanel is coupled to two voltage sources, and does not include any capacitor. A first switch S1 is coupled to a first voltage source V81, which serves to both sides of an equivalent capacitor Cpanel. A second switch S2 is coupled to an X side of the equivalent capacitor and a second voltage source V82. And a third switch S3 is coupled to a Y side of the equivalent capacitor and a third voltage source V83. The present energy recovery circuit 410 includes a first unit U1 coupled to the X side of an equivalent capacitor Cpanel and to the first switch SI, utilized to passing current of charging and/or discharging the equivalent capacitor Cpanel from the X side; and a second unit U2 coupled to the Y side of the equivalent capacitor and to the first switch S1, for passing current of charging and/or discharging the equivalent capacitor Cpanel from the Y side. The present energy recovery circuit 810 further includes a third unit U3 coupled to the first switch S1 and ground. The third unit is equipped with a fourth switch S8.

Figure 9:
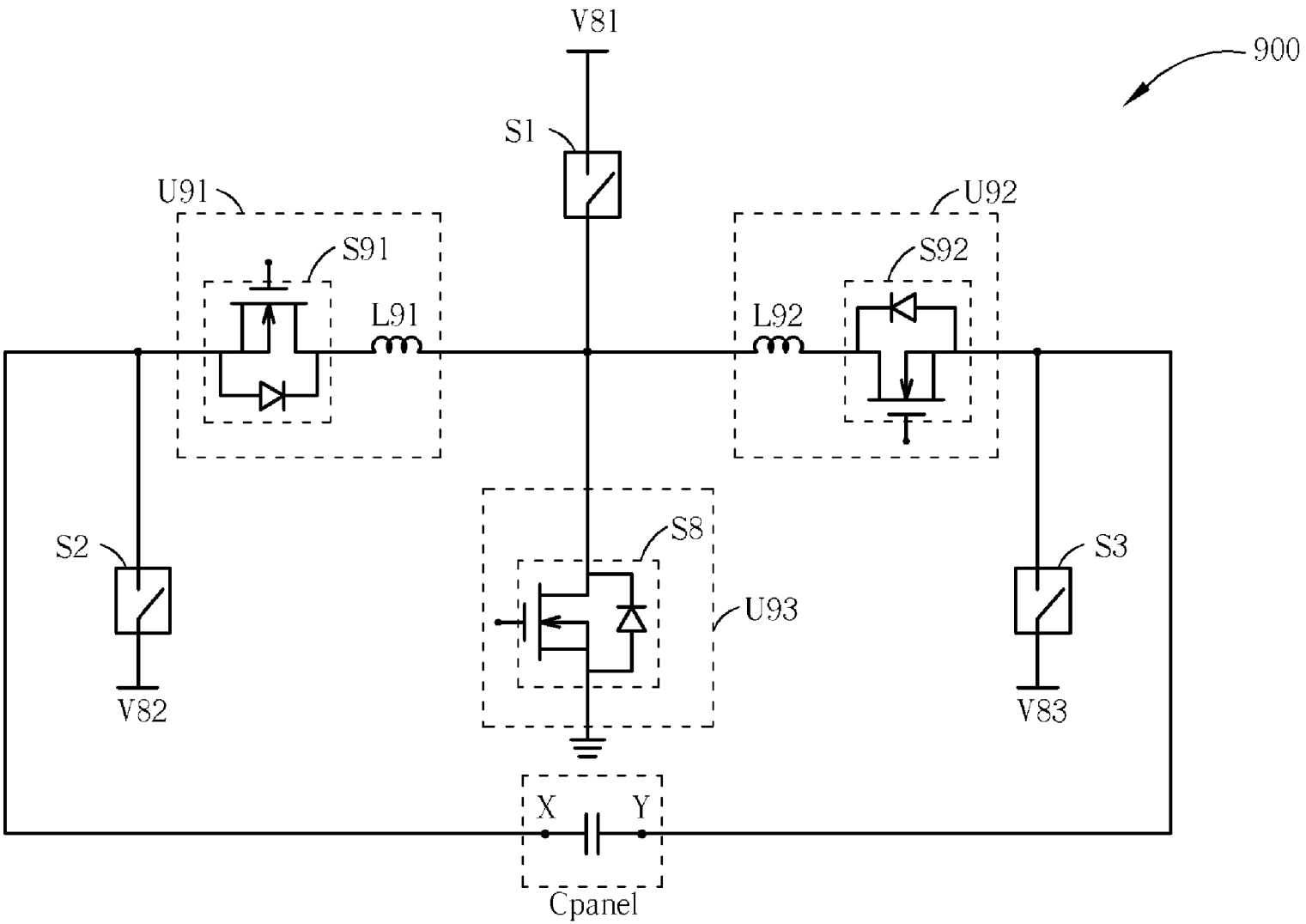
FIG. 9 is a block diagram of a third embodiment of the present invention driver circuit with an equivalent capacitor of a PDP.

Please refer to FIG. 9. FIG. 9 is a block diagram of the third embodiment 900 of the present invention driver circuit. In this embodiment, each of the unit U91 and the unit U92 includes a switch and an inductor which coupled in series. The switch S8 of the unit U93 is directly coupled to the two inductors of the unit U91 and the unit U92. The charging/discharging unit of the X side of the equivalent capacitor Cpanel includes the switches S8 and S91, and an inductor L91; while the charging/discharging unit of the X side of the equivalent capacitor Cpanel in the embodiment 500 of the present invention driver further includes a capacitor C4 as illustrated in FIG. 5. The decrease of required components results from the adoption of the voltage sources V82 and V83. Similarly, the charging/discharging unit of the Y side of the equivalent capacitor Cpanel is composed of the switches S8 and S92, and the inductor L92. The voltage source V81 is coupled to both the charging/discharging unit of the X side of the equivalent capacitor Cpanel and the charging/discharging unit of the Y side of the equivalent capacitor Cpanel for igniting the X side and the Y side of the equivalent capacitor Cpanel respectively. On the other side, the voltage potentials of the X side and the Y side of the equivalent capacitor Cpanel are pulled down to V82 and V83 respectively in discharging stage.

Figure 10:
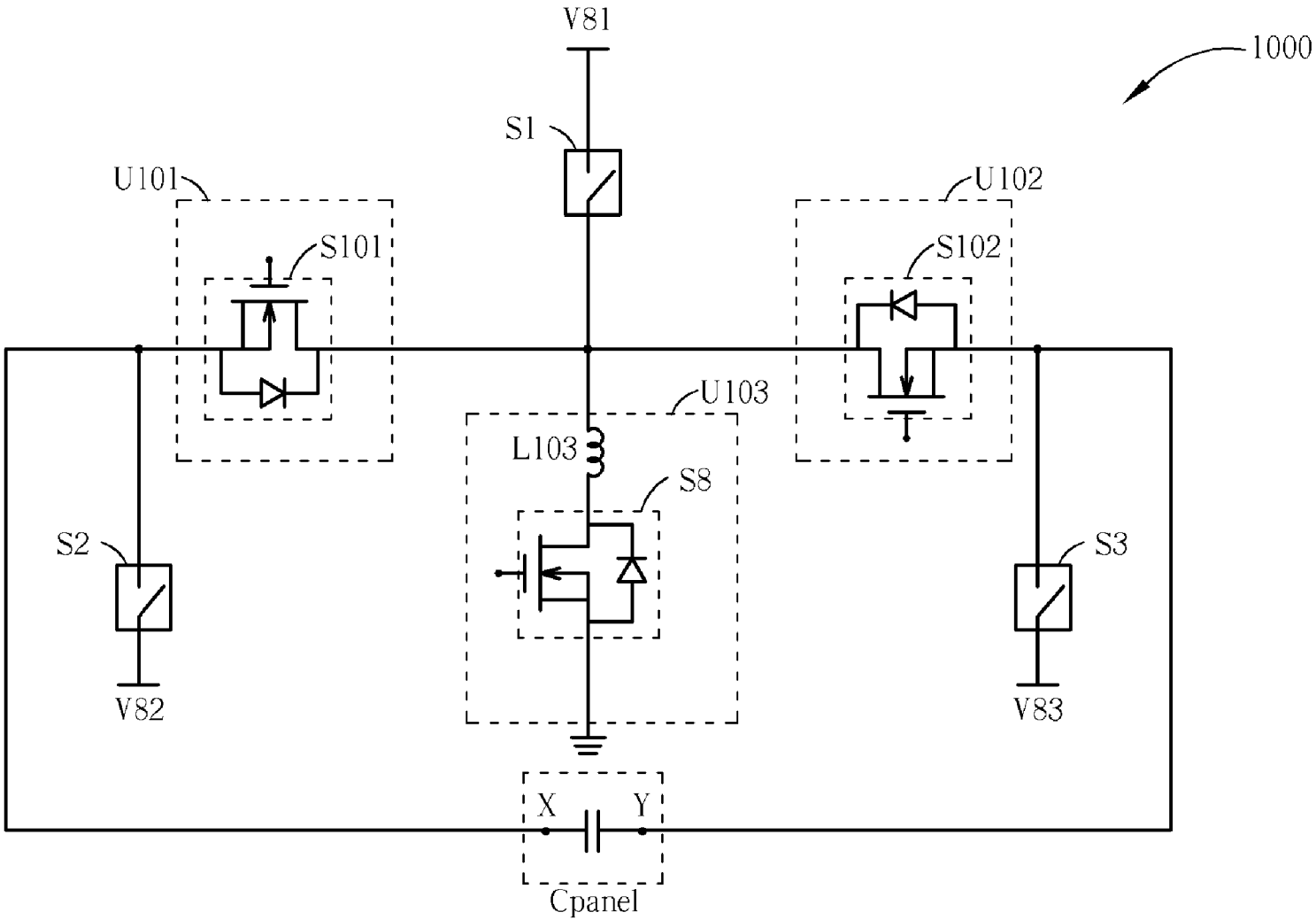
FIG. 10 is a block diagram of a fourth embodiment of the present invention driver circuit with an equivalent capacitor of a PDP.

Please refer to FIG. 10. FIG. 10 is a block diagram of the fourth embodiment 1000 of the present invention driver circuit. In this embodiment, each of the unit U101 and the unit U102 includes only a switch. The unit U103 includes a switch S8 and an inductor L103, coupled in series. The inductor L103 of the unit U103 is utilized in both the charging/discharging unit of the X side of the equivalent capacitor Cpanel and the charging/discharging unit of the Y side of the equivalent capacitor Cpanel. The voltage source V81 is coupled to both the charging/discharging unit of the X side of the equivalent capacitor Cpanel and the charging/discharging unit of the Y side of the equivalent capacitor Cpanel for igniting the X side and the Y side of the equivalent capacitor Cpanel respectively. When charging the X side of the capacitor Cpanel, the switch S101 is turned on, and the X side of the capacitor Cpanel is charged; while the switch S3 is turned on to keep the voltage potential at the Y side of the capacitor Cpanel at V83. When igniting the X side of the capacitor Cpanel, the switch S1 is turned on for passing current from the voltage source V81 to the X side of the capacitor Cpanel; while the switch S3 remains turned on to keep the voltage potential at the Y side of the capacitor Cpanel at V83. When discharging the X side of the capacitor Cpanel, the switch S8 is turned on for passing current from the X side of the capacitor Cpanel through the inductor L103 back to the unit U103.

Similarly, when charging the Y side of the capacitor Cpanel in the present invention driver circuit 1000, the switch S102 is turned on, and the Y side of the capacitor Cpanel is charged; while the switch S2 is turned on to keep the voltage potential at the X side of the capacitor Cpanel at V82. When igniting the Y side of the capacitor Cpanel, the switch S1 is turned on for passing current from the voltage source V81 to the Y side of the capacitor Cpanel; while the switch S2 remains turned on to keep the voltage potential at the X side of the capacitor Cpanel at V82. When discharging the Y side of the capacitor Cpanel, the switch S8 is turned on for passing current from the Y side of the capacitor Cpanel through the inductor L103 back to the unit U103.

In all the aforementioned embodiments of the present inventions, unidirectional switched are utilized for illustrating the claimed circuit and related operations. In fact, bi-directional switches are suited to in the energy recovery circuit of the present invention as well. Compared to the conventional energy recovery circuit of driver circuit of PDP, quite an amount of components are reduced in the first type of energy recovery circuit of the present invention driver circuit, with a unique capacitor utilized for all the charging/discharging channels. In the second type of energy recovery circuit of the present invention driver circuit, the capacitor is further removed from all of energy-forward channels and energy-backward channels of the X side and the Y side of the equivalent capacitor of a plasma display panel with the aid of two more voltage sources. Hence the required amount of utilized components in the present invention energy recovery circuit and the number of control ICs are decreased accordingly, while the recovery rate of energy is maintained. Different variations of the order and connections of the switches and inductors are introduced for different advantages. For the second type of the driver circuit of the present invention, as illustrated in FIG. 8, the absolute values of the two negative voltage sources V82 and V83 can be well designed around the values of the positive voltage source V81. Therefore, the important task of power saving in the PDP display is achieved more efficiently and with lower cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driver circuit comprising:

a first switch having a first end coupled to a first voltage source;

a second switch having a first end coupled to an X side of an equivalent capacitor and a second end coupled to ground;

a third switch having a first end coupled to a Y side of the equivalent capacitor and a second end coupled to ground; and an energy recovery circuit comprising:

a first unit, having a first end coupled to the X side of an equivalent capacitor and a second end coupled to a second end of the first switch, for passing current of charging and/or discharging the equivalent capacitor from the X side;

a second unit, having a first end coupled to the Y side of the equivalent capacitor and a second end coupled to the second end of the first switch, for passing current of charging and/or discharging the equivalent capacitor from the Y side; and a third unit coupled to the second end of the first switch and ground, the third unit comprising:

a capacitor for charging and/or discharging the equivalent capacitor from the X side and/or the Y side; and a fourth switch coupled to the capacitor in series.

2. The driver circuit of claim 1 wherein the first unit comprises:

a first inductor; and a fifth switch, for passing current toward the X side of the equivalent capacitor, coupled to the first inductor in series; and the second unit comprises:

a second inductor; and a sixth switch, for passing current toward the Y side of the equivalent capacitor, coupled to the second inductor in series;

wherein the fourth switch of the third unit is for passing current from the X side and/or the Y side of the equivalent capacitor.

3. The driver circuit of claim 2 wherein the inductances of the first inductor and the second inductor are different.

4. The driver circuit of claim 2 wherein the inductances of the first inductor and the second inductor are the same.

5. The driver circuit of claim 1 wherein the first unit comprises:

a first inductor; and a fifth switch, for passing current from and toward the X side of the equivalent capacitor, coupled to the first inductor in series; and the second unit comprises:

a second inductor; and a sixth switch, for passing current from and toward the Y side of the equivalent capacitor, coupled to the second inductor in series;

wherein the fourth switch of the third unit is for passing current from and toward the X side and/or the Y side of the equivalent capacitor.

6. The driver circuit of claim 5 wherein the inductances of the first inductor and the second inductor are different.

7. The driver circuit of claim 5 wherein the inductances of the first inductor and the second inductor are the same.

8. The driver circuit of claim 1 wherein the first unit comprises a fifth switch for passing current toward the X side of the equivalent capacitor; the second unit comprises a sixth switch for passing current toward the Y side of the equivalent capacitor; and the third unit further comprises an inductor coupled to the fourth switch and the capacitor in series; in which the fourth switch of the third unit is for passing current from the X side and/or the Y side of the equivalent capacitor.

9. The driver circuit of claim 1 wherein the first unit comprises a fifth switch for passing current from and toward the X side of the equivalent capacitor; the second unit comprises a sixth switch for passing current from and toward the Y side of the equivalent capacitor; and the third unit further comprises an inductor coupled to the fourth switch and the capacitor in series; in which the fourth switch of the third unit is for passing current from and toward the X side and/or the Y side of the equivalent capacitor.

10. A driver circuit comprising:

a first switch having a first end coupled to a first voltage source;

a second switch having a first end coupled to an X side of an equivalent capacitor and a second end coupled to a second voltage source;

a third switch having a first end coupled to a Y side of the equivalent capacitor and a second end coupled to a third voltage source; and an energy recovery circuit comprising:

a first unit, having a first end coupled to the X side of an equivalent capacitor and a second end coupled to a second end of the first switch, for passing current of charging and/or discharging the equivalent capacitor from the X side;

a second unit, having a first end coupled to the Y side of the equivalent capacitor and a second end coupled to the second end of the first switch, for passing current of charging and/or discharging the equivalent capacitor from the Y side; and a third unit, for passing charging and/or discharging current of the equivalent capacitor from the X side and/or the Y side, coupled to the second end of the first switch and ground, the third unit comprising a fourth switch.

11. The driver circuit of claim 10 wherein the first unit comprises:

a first inductor; and a fifth switch, for passing current toward the X side of the equivalent capacitor, coupled to the first inductor in series; and the second unit comprises:

a second inductor; and a sixth switch, for passing current toward the Y side of the equivalent capacitor, coupled to the second inductor in series;

wherein the fourth switch of the third unit is for passing current from the X side and/or the Y side of the equivalent capacitor.

12. The driver circuit of claim 11 wherein the inductances of the first inductor and the second inductor are different.

13. The driver circuit of claim 11 wherein the inductances of the first inductor and the second inductor are the same.

14. The driver circuit of claim 10 wherein the first unit comprises:

a first inductor; and a fifth switch, for passing current from and toward the X side of the equivalent capacitor, coupled to the first inductor in series; and the second unit comprises:

a second inductor; and a sixth switch, for passing current from and toward the Y side of the equivalent capacitor, coupled to the second inductor in series;

wherein the fourth switch of the third unit is for passing current from and toward the X side and/or the Y side of the equivalent capacitor.

15. The driver circuit of claim 14 wherein the inductances of the first inductor and the second inductor are different.

16. The driver circuit of claim 14 wherein the inductances of the first inductor and the second inductor are the same.

17. The driver circuit of claim 10 wherein the first unit comprises a fifth switch for passing current toward the X side of the equivalent capacitor; the second unit comprises a sixth switch for passing current toward the Y side of the equivalent capacitor; and the third unit further comprises an inductor coupled to the fourth switch and the capacitor in series; in which the fourth switch of the third unit is for passing current from the X side and/or the Y side of the equivalent capacitor.

18. The driver circuit of claim 10 wherein the first unit comprises a fifth switch for passing current from and toward the X side of the equivalent capacitor; the second unit comprises a sixth switch for passing current from and toward the Y side of the equivalent capacitor; and the third unit further comprises an inductor coupled to the fourth switch and the capacitor in series; in which the fourth switch of the third unit is for passing current from and toward the X side and/or the Y side of the equivalent capacitor.

* * * * *